United States Patent [19]

Pearson

[11] 4,223,803

[45] Sep. 23, 1980

[54] GAS STORAGE SYSTEMS

[75] Inventor: Arthur E. Pearson, Cwmbran, Wales

[73] Assignee: British Steel Corporation, London, England

[21] Appl. No.: 765,105

[22] Filed: Feb. 2, 1977

Related U.S. Application Data

[63] Continuation of Ser. No. 550,609, Feb., 1975.

[30] Foreign Application Priority Data

Feb. 26, 1974 [GB] United Kingdom ..... 8673/74

[51] Int. Cl.[2] ..... B67D 3/00

[52] U.S. Cl. ..... 222/3; 222/95

[58] Field of Search ..... 222/392, 95, 389, 492, 222/382; 417/394; 92/34, 92; 122/35; 60/39, 68

[56] References Cited

U.S. PATENT DOCUMENTS 2,532,143 11/1950 Breit ..... 92/92 X 2,836,963 6/1958 Fox ..... 92/92 X

FOREIGN PATENT DOCUMENTS 678736 9/1952 United Kingdom ..... 60/39.68

*Primary Examiner*—John J. Love

*Assistant Examiner*—Norman L. Stack

*Attorney, Agent, or Firm*—Brisebois & Kruger

[57] ABSTRACT

A storage system for a combustible gas comprises a collapsible container selectively connectable to a source of the gas and to a suitable discharge point together with means effective cyclically to produce controlled expansion of the container so as to enable gas to be transferred from the source for storage and to produce collapse of the container to enable stored gas to be discharged.

19 Claims, 2 Drawing Figures

GAS STORAGE SYSTEMS

Figure 1:
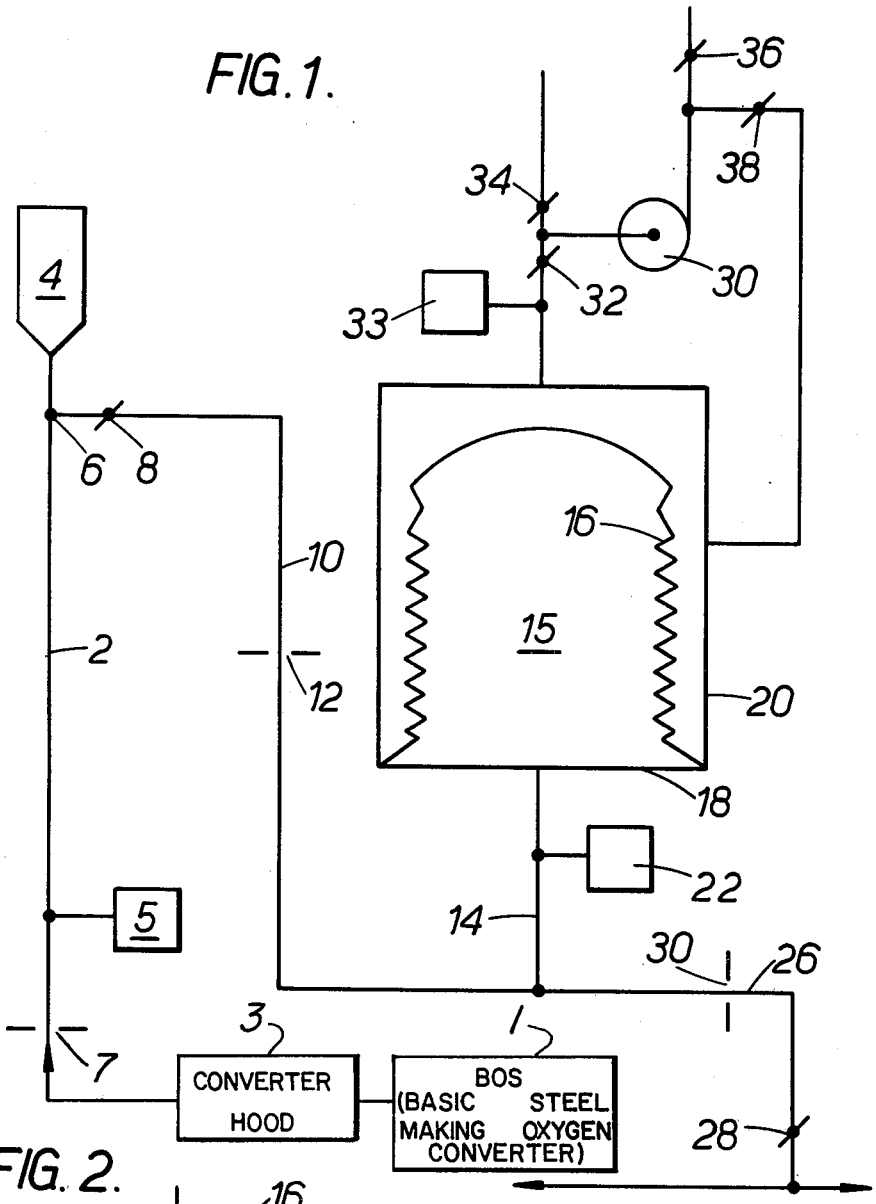

This is a continuation of application Ser. No. 550,609, filed Feb. 18, 1975.

This invention relates to the storage of gases and is particularly concerned with the storage for reuse of carbon monoxide obtained as a reaction by-product in basic oxygen steelmaking.

In a basic oxygen steelmaking process iron derived from a blast furnace is refined by blowing oxygen into the melt contained in a suitable converter. During refining, some impurities in the iron react with the blown oxygen to form a slag which floats to the top of the melt and which can subsequently be separated from the refined metal poured from the converter.

A predominant impurity in iron derived from a blast furnace is carbon which can be present in concentrations of up to 5% weight. During refining this contained carbon is oxidised by blown oxygen and the reaction product is evolved from the converter as carbon monoxide gas. During blowing a proportion of the iron in the converter also is oxidised and is evolved as fine particulate iron oxide, which is entrained as fume in the carbon monoxide.

In conventional BOS converters, the evolved iron oxide-carbon monoxide gas stream generally is discharged into a stack which terminates at its upper end in a suitable flare at which the gas stream is burnt in atmosphere. In order to avoid contamination of the ambient, the gas stream from the converter is cooled by bringing it into heat exchange relationship with water flowing in a cooling circuit and is subsequently water scrubbed to remove iron oxides.

The flaring of the carbon monoxide at the stack outlet is recognised as representing a considerable loss of potentially combustible gas which could be used as an energy source in other processes or in energy conversion for example to mechanical or electrical power. Generation of carbon monoxide in BOS is however intermittent and a number of methods have been proposed for storing the gas stream from the converter for reuse as and when required.

Difficulties inherent in any storage scheme for carbon monoxide gas arise from the highly explosive characteristics of carbon monoxide when diluted with oxygen or with air, and from the high level of toxicity of carbon monoxide to living beings. It is accordingly an object of the present invention to produce a combustible gas storage system which can be used inter alia with the gas reaction products of basic oxygen steelmaking and in which the risks arising from leakage are reduced.

According to one aspect of the present invention a storage system for a combustible gas comprises a collapsible container selectively connectable to a source of the gas and to a suitable discharge point together with means effective cyclically to produce controlled expansion of the container so as to enable gas to be transferred from the source for storage and to produce collapse of the container to enable stored gas to be discharged.

By the use of the invention, the controlled and independent expansion of the container can produce gas storage substantially at the pressure of the gas source; thus in the case where the gas source comprises the stack of a BOS converter in which gas pressure is substantially that of atmosphere, gas will be drawn from the stack also at substantially atmospheric pressure and will be stored at this pressure. In the case where the gas source is at a pressure above atmosphere, any suitable means of pressure reduction, for example by the use of a controlled orifice of selected flow impedance can be used.

The absence of a significant pressure differential between the gas when stored and the oxygen containing ambient will reduce to a minimum the risk of dilution of the gas or of the ambient and accordingly will reduce the possibility of an explosive mixture being formed. Here while in ideal circumstances the gas pressure in the storage container is matched to that of the atmosphere, higher or preferably lower pressures may be provided according to circumstances.

In a preferred embodiment of the invention the collapsible container is sealed into a chamber from which the air or other ambient for example an inert gas can be exhausted at a selected rate to produce the required degree of and rate of expansion for storage and into which the air or ambient can be re-introduced to produce collapse with accompanying discharge of stored gas. Suitably the chamber can be exhausted and filled by way of a blower arranged selectively to pump air into or out of the chamber. Suitable valves are introduced into the system to ensure that during expansion of the container gas is drawn only from the source and that during collapse the gas is discharged only into a suitable outlet.

Suitably the container comprises a large bag of flexible sheet material which may be of rubber or a plastics material such as polyvinyl chloride.

Gas analysis equipment preferably is provided to sample gas drawn from the source and to provide an indication when this is contaminated to an unacceptable level. Shut-off with the collapsible container to prevent gas being drawn for storage if contamination rises above the level at which an explosive mixture may be produced. The shut-off valves may be arranged to operate automatically in response to a signal from the analyser or may be manually operated. As an additional safeguard a similar analyser may be provided in the chamber to enable leakage from the container to be detected.

Figure 2:
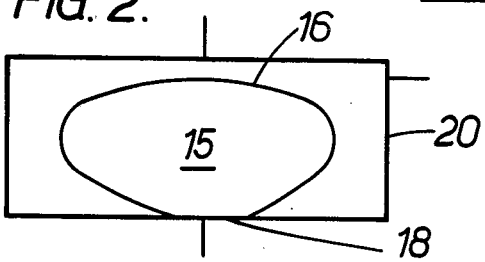

An embodiment of the invention will now be particularly described by way of example with reference to the accompanying drawings in which;

FIG. 1 is a schematic diagram of a system for storing carbon monoxide evolved from a basic oxygen steelmaking process, and FIG. 2 illustrates an alternative form of gas storage vessel to that shown in FIG. 1.

Referring to the drawing the storage system is adapted to receive gas from a BOS converter 1 which discharges through a flare stack 2 terminating at its upper end in a burner 4.

The lower end of the stack 2 receives cool scrubbed gas from the converter by way of the conventional converter hood 3 and a flow rate measuring device 7 of the kind well known in the art.

Evolved gas comprising carbon monoxide which normally is burnt at the burner 4 is tapped for storage at the station which is controlled by a shut-off valve 8 permits gas flow through conduit 10 into a common inlet/outlet 14 of a storage container indicated generally at 15. A meter 12 monitors the rate of gas flow into the container which comprises a collapsible bag 16 of a suitable grade and gauge of polyvinyl chloride or rubber or a suitable combination thereof. The open end of the bag is sealed into the base 18 of a rigid chamber 20 which encloses the bag and which is of sufficient volume to accomodate the bag when fully expanded. In its fully expanded condition, a bag will be of sufficient volume to accomodate the quantity of carbon monoxide evolved during one refining operation in a converter, and a bag of some 1 million cubic feet will be sufficient to accomodate the carbon monoxide gas evolved from a typical refining operation in a converter of some 250 tons capacity.

The common inlet/outlet 14 which also is provided with a gas analyser 22 to monitor the onset of a potentially explosive mixture of carbon monoxide with oxygen or air and is connected also to a duct 26 effective to discharge gas stored in the container 16 gas by way of shut-off valve 28 and a flow meter 24.

Chamber 20 may be provided with windows so that the movement and extent of expansion of the bag or balloon can be observed together with any cracking or other failure of the bag fabric.

A fan 30 selectively connected into chamber 20 by way of shut-off valves 32–38 is effective to evacuate the chamber with valves 38–34 closed and valves 32 and 36 open so as to cause container 15 to expand independently of internal gas pressure and thereby to draw or syphon gas from the source stack 2. Depending on the rate of expansion which is controlled by the adjustable pumping rate of fan 30, gas drawn for storage into the container will be substantially at atmospheric pressure. A gas sample analyser 33 is provided to test air in the chamber 20 to ensure that no leakage has occurred from container 16.

Collapse of the container to discharge stored gas through duct 26 is achieved with valves 34 and 38 open and valves 32 and 36 closed, and valve 8 closed to pump air into the chamber 20.

In use of the storage system valves 8 and 28 initially are closed with the container 16 fully collapsed. At this point which generally is immediately before the beginning of an oxygen steelmaking blow, air is being drawn through the cooler and scrubber associated with the stack 2 and is being discharged to atmosphere by way of the flare 4.

As oxygen blowing commences the carbon monoxide produced is sampled by the analyser 5 for oxygen, carbon monoxide and carbon dioxide content. With gas flow established and detected as being substantially free of oxygen or air, valve 8 is automatically or manually opened in response to an acceptable reading from analyser 5 and flow meter At this stage fan 30 with valves 32 and 36 open and valves 34 and 38 closed, draws air from the chamber 20 to produce expansion of container 16; expansion accordingly draws carbon monoxide from the flare stack 2 for storage by way of duct 10 and continues until a pre-determined point before the end of the blow. The pumping rate of fan 30 is controlled so that the gas withdraw rate as measured by gauge 12 is slightly lower than the flow rate through the flare stack 2 measured by gauge to ensure that air is not drawn down the flare stack and into the conduit 10.

At the pre-determined point the fan 30 is opened to atmosphere and valve 8 is closed. At this stage container 16 contains carbon monoxide at substantially atmospheric pressure so that the pressure differential across the container is substantially zero and is effective to reduce to a minimum any risk of leakage capable of producing a potentially explosive or toxic mixture. Moreover analyser 22 has monitored the quality and possible contamination of the stored gas so that its acceptability for reuse can be assessed before it is discharged through the outlet duct 26.

In the case where the carbon monoxide stored in container 16 is found to be unacceptably contaminated it can be discharged into stack 2 for combustion at the flare 4 together with the gas produced during a subsequent oxygen blow. The rate of discharge is selected so that the overall contamination at the flare 4 is below explosive level.

Discharge of acceptable gas for example for combustion in a boiler or a gas turbine is achieved by opening valve 38 and 34 with valves 32 and 36 closed.

In the alternative embodiment of the invention illustrated in FIG. 2, the bag 16 of FIG. 1 which is of corrugated wall cylindrical form to assist collapse is replaced with a bag in the form of an oblate spheroid. As with the cylinder of FIG. 1, the spheroid of FIG. 2 is shaped to permit optimum collapse of the bag 16 so that in the collapsed condition the contained volume is reduced to a minimum preferably substantially zero. With the contained volume at collapse approaching substantially zero, the risk of contamination of a stored charge by residue from a charge stored in a previous cycle is considerably reduced; moreover by ensuring that the bag 16 can be expanded to the maximum extent permitted by the container 20 any contaminated residue from a previously stored cycle will be diluted as far as possible to further reduce any risk from combustion.

It will be appreciated that the invention described possesses a number of advantages and avoids a number of the disadvantages inherent in gas storage systems for combustion and potentially explosive gases. Thus for example since during storage the pressure differential across the container 16 is small and is dictated solely by the dead weight of the container, the likelihood of leakage is small. Any leakage will be detected by analyser 33. Moreover any leakages of stored gas at valve 8 will be carried away by the flare stack 4 so that the closer the tap-off station is to the upper end of the stack the better.

The carbon monoxide within container 16 and ducts 10 and 26 is always at a pressure virtually equal to the pressure of air in chamber 20 which is controlled by fan 30 and associated valves. The carbon monoxide pressure within container 16 is therefore always under control and can be made greater than, equal to, or less than ambient, at will.

In addition the storage system does not interfere with the basic oxygen refining operation and in particular any fault in the gas collection system does not prevent continuation of steelmaking.

It will be appreciated that while the invention has been described with reference to one container 16 connected to draw carbon monoxide from a single flare stack 2, a plurality of containers can be provided and can be selectively interconnected to a number of flare stacks associated with different converters so that continuous storage facilities are made available irrespective of the blowing programme.

It will be appreciated that the storage system of the invention can be used for the retention of any gas whether combustible toxic or not.

We claim:

1. In combination with apparatus which evolves gas durng an operation and releases at least a given quantity of gas suitable for storage through a gas outlet of said apparatus during a portion of said operation, an improved gas storage and discharge system which comprises container means for storing said gas at substantially atmospheric pressure, said storage means comprising collapsible container means dimensioned to hold substantially said given quantity of said gas suitable for storage, conduit means between said gas outlet, said collapsible container means, and a discharge point, valve means associated with said conduit means for selectively connecting said container means to said outlet and to said discharge point, said valve means being operable to continuously connect said container means to said outlet only so long as said gas suitable for storage is being released through said outlet, and additional means operable other than by the pressure of the gas in said outlet and in said conduit means to cause continuous expansion of the container so as to permit gas to be continuously transferred from said outlet for storage in said container while said gas suitable for storage is being released through said outlet, said additional means including means to cause contraction of said container to enable stored gas to be discharged from said container to said discharge point.

2. A gas storage system as claimed in claim 1 in which said gas source is a flare stack for a basic oxygen steelmaking converter, to which stack said container means is connected by duct means connected to said stack at a station adjacent the upper end thereof.

3. In combination with apparatus which evolves up to a given quantity of gas during an operation and which releases said gas through the outlet of said apparatus, a gas storage and discharge system which comprises container means for storing said gas at substantially atmospheric pressure, said storage means comprising collapsible container means dimensioned to hold substantially said given quantity of gas, conduit means connecting said gas outlet to said container means, valve means in said conduit means for selectively connecting said container means to said outlet during evolution of said gas and to a suitable discharge point other than said outlet at a time when gas is not being evolved, said valve means being adapted to continuously connect said container means to said outlet so long as said gas is evolving, and additional means operable independently of the pressure of the gas in said outlet and in said conduit means to cause continuous expansion of the container so as to permit gas to be continuously transferred from said outlet for storage in said container during the time when said gas is being evolved by said apparatus, said additional means including means to cause contraction of said container to enable stored gas to be discharged from said container to said discharge point at said other time.

4. A system for the storage of gas derived from apparatus which evolves at least a given quantity of gas during operation, the system comprising container means for storing said gas at substantially atmospheric pressure, said storage means comprising a collapsible container dimensioned when expanded to hold substantially the given quantity of gas, conduit means for transferring gas from said apparatus to said container, conduit means for transferring gas from said container to a point for discharge of the gas, valve means in said conduit means for selectively connecting said container to said apparatus and to said discharge point, the container being sealed into a non-collapsible housing, and reversible low pressure air moving means connected between said housing and ambient atmosphere for expanding said container for storage of said gas other than by the pressure of evolved gas by removing air from the housing, and for collapsing the container to discharge gas from the container to said discharge point, by moving air into the housing.

5. A gas storage system as claimed in claim 4 in which said apparatus comprises a flare stack connected to a basic oxygen steel making converter, to which stack said container is connected by said conduit means at a station adjacent the upper end of said stack.

6. A gas storage system as claimed in claim 4 wherein said reversible air mover comprises blower means arranged selectively to pump ambient air out of and into the housing.

7. A gas storage system as claimed in claim 4 wherein the container is shaped to collapse to a minimum contained volume.

8. A gas storage system as claimed in claim 4 which further includes gas analyser means to test the quality of gas entering or gas leaving the collapsible container.

9. A gas storage system as claimed in claim 4 wherein the container is of spherical form.

10. A gas storage system as claimed in claim 9 wherein the sphere is flattened to assist collapse.

11. A gas storage system as claimed in claim 4 wherein a gas analyser is included to test the ambient from the chamber.

12. A gas storage system as claimed in claim 4 wherein the container is of cylindrical form in outline.

13. A gas storage system as claimed in claim 12 wherein the cylinder wall is corrugated to assist collapse.

14. A gas storage system as claimed in claim 4 wherein the collapsible container comprises a bag of flexible sheet material.

15. A gas storage system as claimed in claim 14 wherein the sheet material is of rubber.

16. A gas storage system as claimed in claim 14 wherein the sheet material is of a plastics material.

17. A gas storage system as claimed in claim 16 wherein the plastics material is polyvinyl chloride.

18. A gas storage as claimed in claim 16 wherein the plastics material is mixed with rubber.

19. A gas storage system as claimed in claim 14 wherein the flexible sheet material is reinforced by a suitable fabric.

* * * * *